US007377717B2

(12) United States Patent
Clark et al.

(10) Patent No.: US 7,377,717 B2
(45) Date of Patent: May 27, 2008

(54) TRAFFIC DELINEATOR ALIGNMENT SYSTEM

(76) Inventors: Richard O. Clark, 7162 CR 176, Stephenville, TX (US) 76401; Timothy Andrew Coyle, 39, Broolands Rd., Hall Green, Birmingham BZ8 8LA (GB)

( * ) Notice: Subject to any disclaimer, the term of this patent is extended or adjusted under 35 U.S.C. 154(b) by 189 days.

(21) Appl. No.: 10/558,138

(22) PCT Filed: Jul. 18, 2003

(86) PCT No.: PCT/US03/22646

§ 371 (c)(1),
(2), (4) Date: Nov. 22, 2005

(87) PCT Pub. No.: WO2005/007262

PCT Pub. Date: Feb. 24, 2005

(65) Prior Publication Data

US 2007/0053743 A1 Mar. 8, 2007

(51) Int. Cl.
*G09F 15/00* (2006.01)

(52) U.S. Cl. ..... 404/10; 40/608; 40/612; 116/63 R

(58) Field of Classification Search ..... 404/10, 404/9; 40/608, 612; 116/63 R
See application file for complete search history.

(56) References Cited

U.S. PATENT DOCUMENTS 1,313,616 A * 8/1919 Walsh ..... 40/608
1,384,365 A * 7/1921 Walsh ..... 40/608
1,402,465 A * 1/1922 Wood ..... 40/608
1,679,623 A 8/1928 Olsen
1,688,398 A * 10/1928 Rank et al. ..... 40/608
1,709,190 A * 4/1929 Rank et al. ..... 40/608
4,270,873 A * 6/1981 Laehy et al. ..... 404/10
4,565,466 A * 1/1986 Daggs et al. ..... 404/10
4,806,046 A * 2/1989 Clark ..... 404/10
5,199,814 A * 4/1993 Clark et al. ..... 404/10
5,273,371 A * 12/1993 Hugron ..... 404/10

FOREIGN PATENT DOCUMENTS

| | | |
|---|---|---|
| EP | 0112804 | 7/1984 |
| GB | 93 01 135.0 | 1/1993 |
| WO | WO 92/13139 | 8/1992 |

* cited by examiner

*Primary Examiner*—Gary S Hartman
(74) *Attorney, Agent, or Firm*—Thoamas E. Sisson; Mark H. Miller; Daniel D. Chapman

(57) ABSTRACT

A load assembly for a self-uprighting delineator which moves from a first upright position to a second yielded or deflected position upon impact and returns to the upright position after impact. The assembly has upper and lower cell elements that have cooperating and complimentary alignment members in the form of notches and ridges. When the assembly is twisted, the alignment members cause the upper and lower cells to properly align the spring loaded cables passing through cable passages in the elements.

7 Claims, 5 Drawing Sheets

TRAFFIC DELINEATOR ALIGNMENT SYSTEM

BACKGROUND OF THE INVENTION

The present invention relates to an impact recovery delineator system having a delineator post, a signage panel, and a fixed or portable base system which facilitates pivoting from a normally aligned, upright position to a substantially horizontal, yielded position upon being impacted by a moving object such as an automotive vehicle. More specifically, this invention relates to the unique load cell elements designed to reduce the impact force required to pivot the post upon impact, to speed the return of the post to its upright position, and ensure that the pivoting load assembly and the signage panel are properly oriented to direct traffic upon returning to the upright position.

U.S. Pat. Nos. 4,806,046; 5,199,814; 6,036,400; and 6,416,248, teach the current state of the art for such devices, and each is incorporated herein by reference for all purposes. However, certain problems still exist with existing posts and bases, which the present invention seeks to overcome.

While it is well known that delineator posts are frequently accidentally stuck in an incalculable number of directions, the most important factor is that the signage eventually resume its original proper orientation with respect to the direction of oncoming traffic. Further, it seems that certain individuals find pleasure in twisting such signage to confuse and either, intentionally or unintentionally, to endanger drivers approaching the traffic delineator. Unless the delineator is properly designed, such twisting can result in the signage not returning to the proper orientation upon release of the twisting force.

The present invention aims to ensure that irrespective of the origin of the twisting impact upon the delineator, the signage automatically, and consistently, returns to the proper predetermined orientation. The unique arrangement of upper and lower load cell elements of the present delineator with two spaced apart tension cables in separate radiused passages cooperating with alignment edges on the faces of the load cell elements results in achieving the desired results.

DETAILED DESCRIPTION OF THE PREFERRED EMBODIMENT

Figure 1:
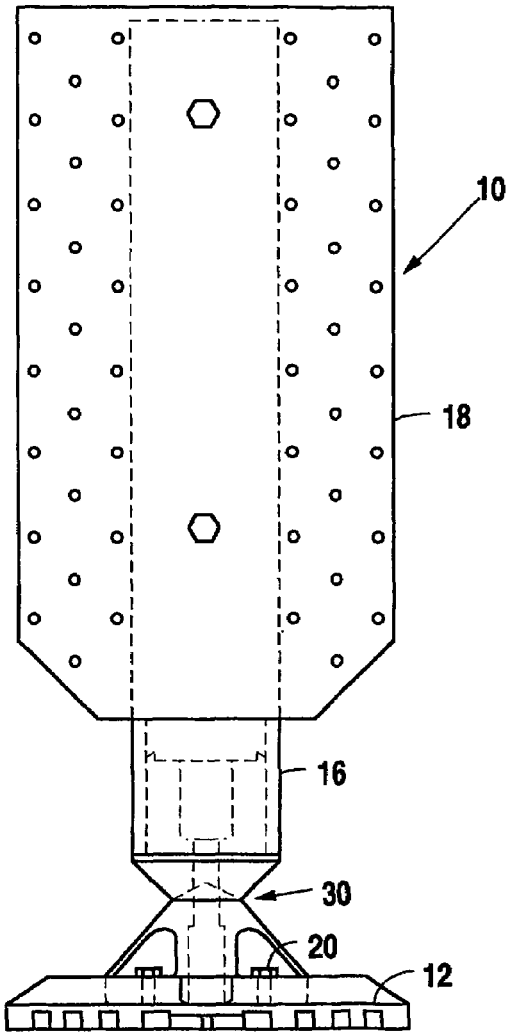
FIG. 1 illustrates a front elevational view of an embodiment of the present inventive delineator system in the upright position facing the direction of oncoming traffic.
Figure 1A:
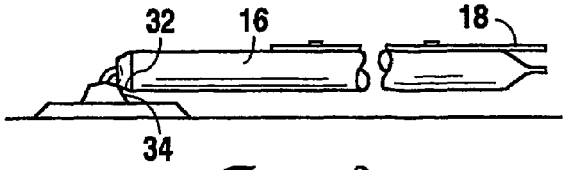
FIG. 1A is a side elevational view of a delineator post in the yielded position.

Referring now to the drawings and first to FIG. 1, a self-uprighting delineator post construction is illustrated generally at 10 which incorporates a base 12, a load cell assembly illustrated generally at 30 and a light weight post 16. The upper end of the light weight post may be provided with a reflector 18 which may be attached with adhesive, bolted on or otherwise attached to the lightweight post to provide reflection of light, thus permitting the post to be readily visible under night driving conditions. The post and the reflector may be of a suitable color enabling it to be readily visible during daylight conditions. The material composing the post 16 may comprise any one of a number of suitable light weight polymer materials that are impact resistant. Since the post is of light weight construction, it does not present significant resistance to impact forces when it is accidentally struck such as by an automotive vehicle. This feature prevents damage to the post and also prevents damage to the automotive vehicle as the post is accidentally struck and shifted from the upright position shown in FIG. 1 to the deflected or yielded position shown in FIG. 1A.

Figure 2A:
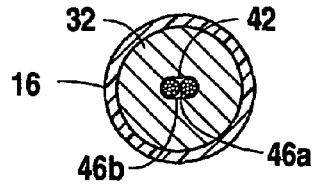
FIG. 2A shows a partial cross-sectional view taken along line A-A of FIG. 2, and illustrates the single cable channel of the present invention.
Figure 2:
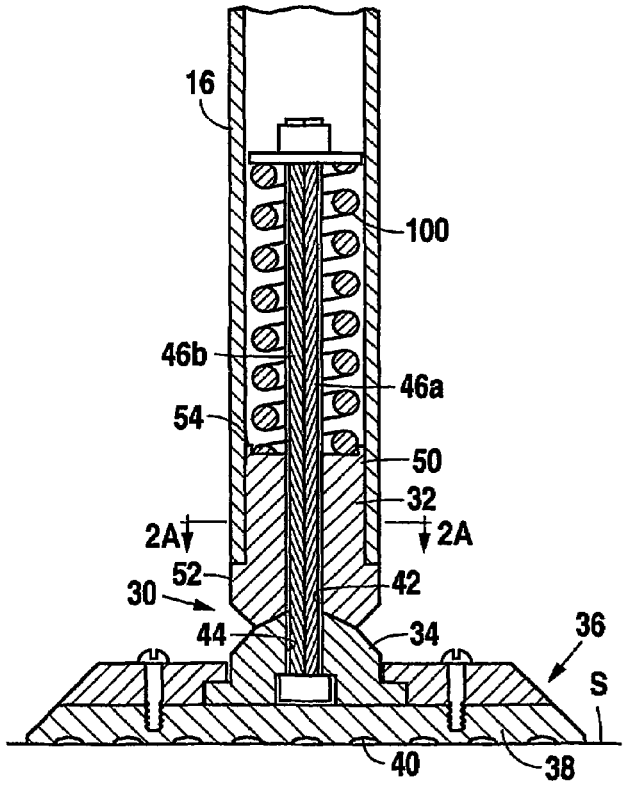
FIG. 2 shows a front elevation, partial cross-sectional, view of a delineator system of the present invention having a single cable channel.

Referring now to FIG. 2, a self-uprighting delineator post construction of the present invention is illustrated. A load cell assembly is illustrated generally at 30 which incorporates an upper load cell element 32 and a lower load cell element 34 which is supported by a base assembly generally shown at 36. The base assembly 36 incorporates a base plate 38 forming a lower surface 40 that is prepared in any suitable fashion to be placed (bonded or portable) to any suitable surface S, such as a roadway surface.

The upper load cell element 32 has a central passage 42 and a lower load cell element also has a central passage 44 both of oval cross-sectional configuration to receive the two cable members 46*a* and 46*b*. The passages 42 and 44 are axially aligned. FIG. 2A illustrates a partial cross-sectional view of such a cable passage 42 as a single channel in upper load cell 34. Cables 46*a* and 46*b* extend there through. Alternatively, the upper and lower cell elements maybe provided with two spaced apart cable channels 43*a* and 43*b* as illustrated in FIG. 3A. The single channel 42 and the double channels 43*a* and 43*b* may provide with radiused edge portions to facilitate the yielding and uprighting features of the delineator post as will be discussed below.

Figure 3:
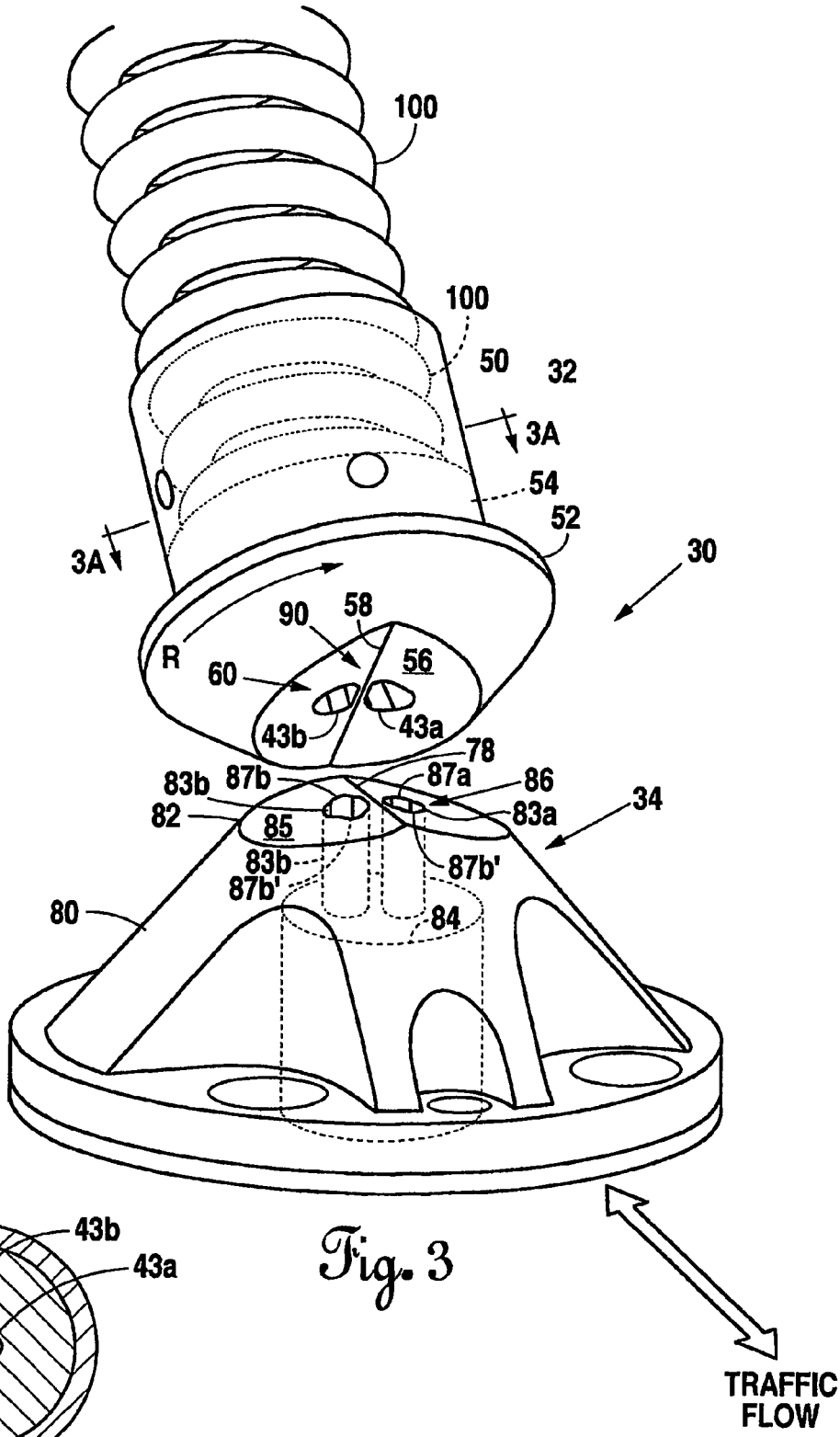
FIG. 3 illustrates an exploded perspective view of the upper and lower load cell elements of the present invention showing the orientation edges and showing a double cable channel passage.
Figure 3A:
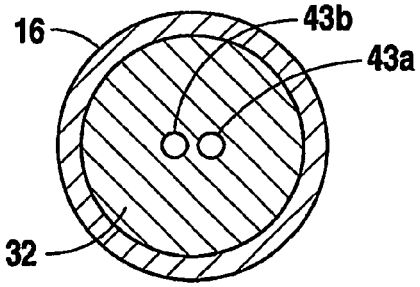
FIG. 3A shows a partial cross-sectional view taken along line B-B of FIG. 3, and illustrates a double cable channel passage.

A load cell assembly 30 of the present invention with its combination of features is shown in one embodiment in FIG. 3. FIG. 3 illustrates passage system for the cables which pass through double channels in the upper and lower load cell elements. The upper load cell element 32 has a neck portion 50 and a cap section 52. Within the neck portion is a load spring neck cavity 54 (FIGS. 6 and 10) for retaining the load spring 100 which causes the post 16 to bend and spring back as is known in the art.

An upper cable passage 60 is formed by two spaced apart cable channels 43*a* and 43*b* which extend from inside the neck cavity 54 through the cap face surface 56 of the cap section 52. The cap face surface 56 has an orientation alignment member or edge 58 which cooperates with a complimentary orientation alignment member or edge 78 on the lower load cell element 34 to properly align the load assembly 30 and thus align the cables and delineator post 16 (with respect to the traffic flow) when the post moves from an upright orientation (FIG. 1) to a yielded position (FIG. 1A) and back to the upright position or when the delineator signage has been rotationally twisted.

The lower load cell element 34 has a base section 80 and a head portion 82. A cable locking base cavity 84 (FIGS. 5 and 9) is formed within the lower load cell element 34 to secure the spring loaded cables within the cell element. As can be seen in FIG. 3, the lower load cell cable passage 86 is also formed by two spaced apart cable channels 83*a* and 83*b* which extend from inside the base cavity 84 through the base head face surface 85 of the base head portion 86. As with the upper load cell element, the lower load cell element 34 has an orientation edge 78 along the base head face surface 85.

In the embodiment of FIG. 3, the upper cell element orientation edge 58 is disposed as a concave notch 90 in the cap section 52; and, more particularly, the edge 58 is an indentation along the cap face surface 56 between the cable channels 43*a* and 43*b*. The complimentary orientation edge 78 in the base head face surface of the lower load cell element is disposed as a convex ridge which extends across the head face surface 85, between the cable channels 83*a* and 83*b*.

It should be understood that the orientation edges 58 and 78 may be reversed with the notch formed in the base head face surface of the lower load cell element and the ridge formed in the cab face surface 56. (See FIGS. 5A, 6A, 9A and 10A)

In operation, if the upper load cell element 32 is rotated or twisted (see arrow direction R in FIG. 3) with respect to the lower load cell element, the tapered sides of the face surfaces 56 and 86 and the orientation edges 58 and 78 become misaligned. The tension of the cables in the cable passage tends to urge the twisting elements back into alignment. The ridge 78 and notch 58 complete the alignment process when they cooperate to align along their longitudinal axis with each other as a result of the tapered face surfaces, the complimentary edge, and the cable tension.

Figure 4:
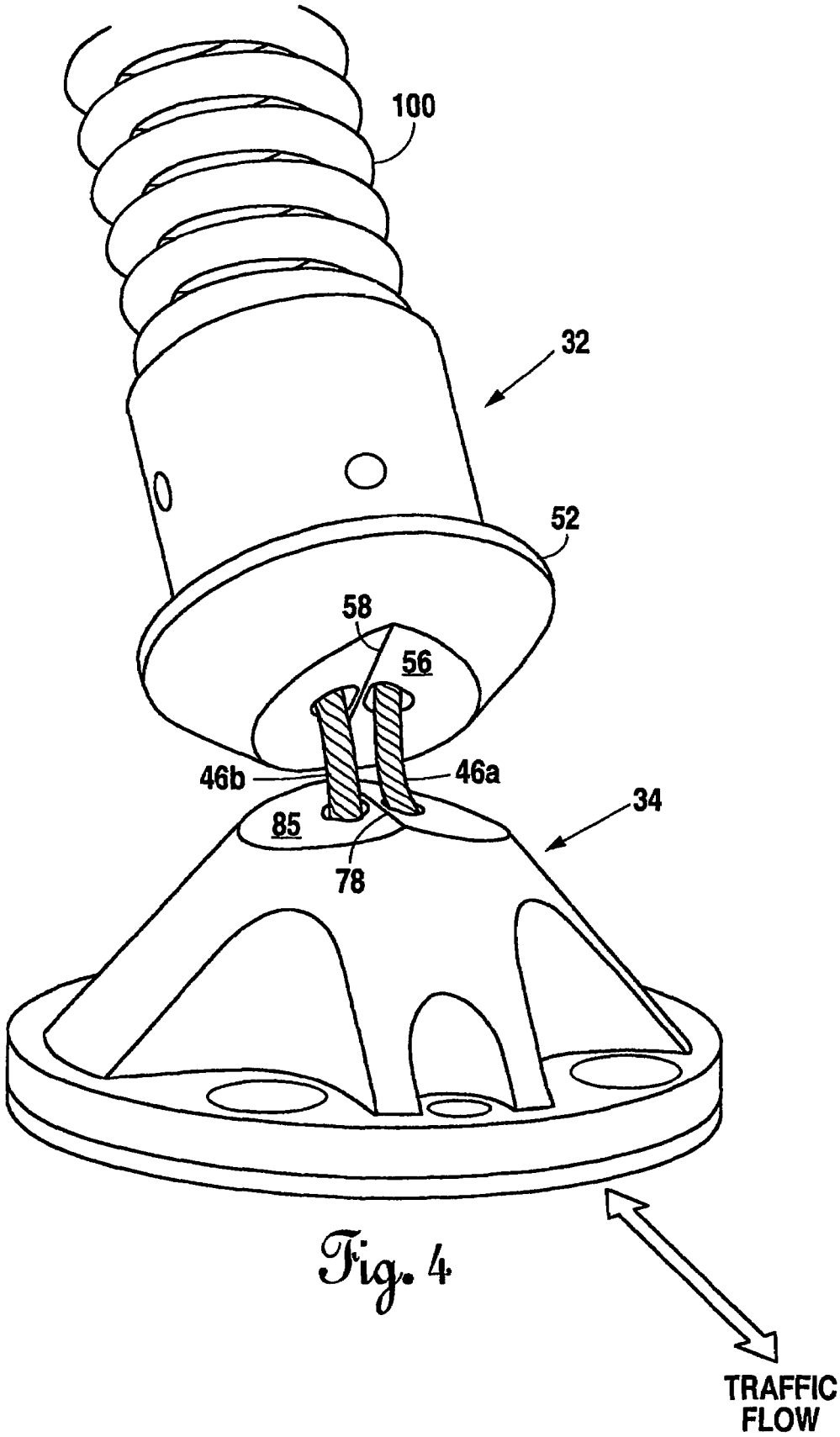
FIG. 4 shows the load cells of FIG. 3 with the cables passing through separate cable channels.

FIG. 4 illustrates the embodiment of FIG. 3 with the spring load cables 46*a* and 46*b* extending through the cable passages made up of spaced apart cable channels in the upper and lower cell elements. The upper element 32 is shown in a partially flexed, yielded or deflected position and somewhat separated from the lower load cell element. This may occur when the delineator post is struck by an oncoming vehicle. The direction of traffic flow is parallel to the longitudinal axis of the alignment edges 58 and 78.

Figure 5:
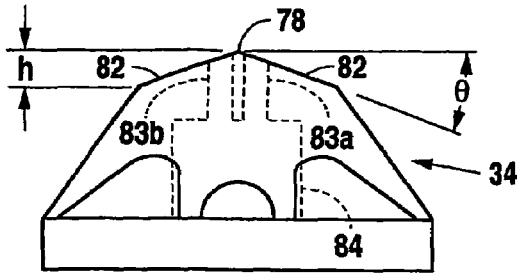
FIG. 5 is a side elevation plan view of a lower load cell element of one embodiment of the present invention having separate cable channels.

FIG. 5 is a side elevation view of one embodiment lower cell element of the present invention. The head section 82 of the element has been tapered from the horizontal by an angle $\ominus$. Studies have shown that where $\ominus$ is in the range of about 5° to about 20°, the realignment of the load assembly is enhanced. An angle of 13° appears to provide the most reliable realignment of the assembly. The height h of ridge 58 is equal to the depth d of the notch 78 (FIG. 6) to ensure proper engagement of the cells after displacement of the delineator upon impact or twisting.

Figure 6:
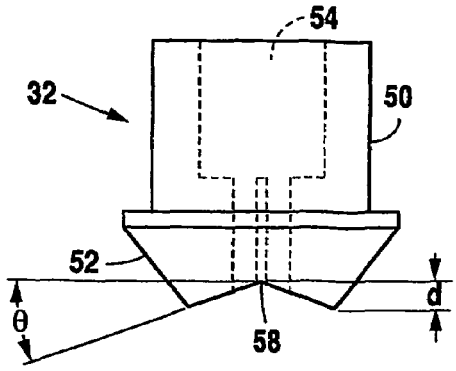
FIG. 6 is a side elevation plan view of the upper load cell element of a complimentary embodiment to the lower load cell of FIG. 5.
Figure 7:
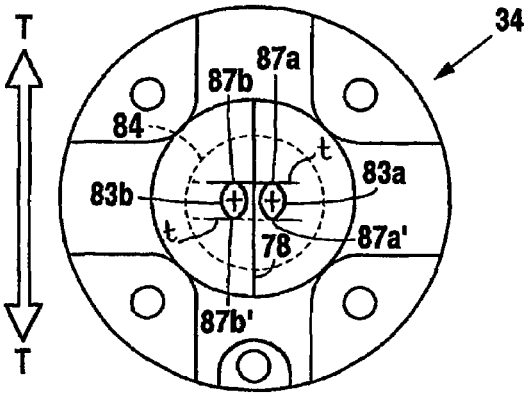
FIG. 7 is a top plan view of the lower load cell element of FIG. 5.
Figure 8:
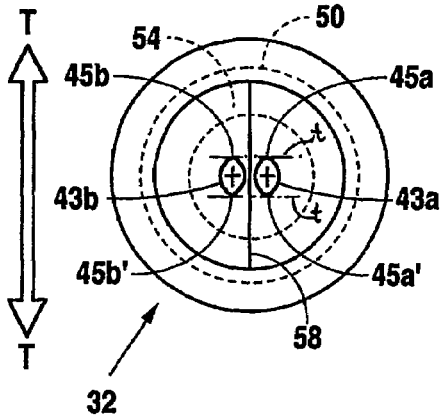
FIG. 8 shows a top plan view of the upper load cell element of FIG. 6.
Figure 9:
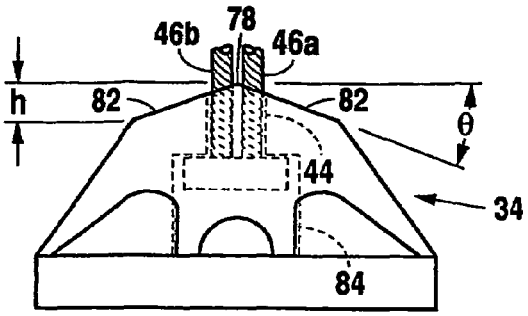
FIG. 9 is a side elevation plan view of a lower load cell element of another embodiment of the present invention having a single cable channel.
Figure 10:
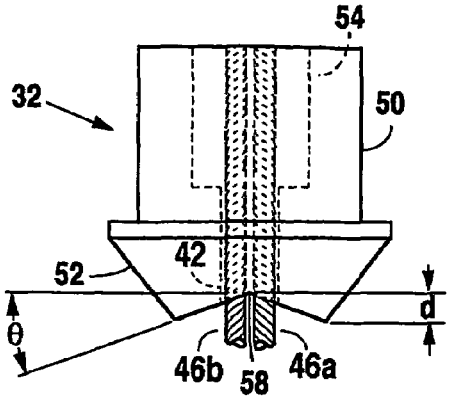
FIG. 10 illustrates a side elevation plan view of a complimentary upper load cell element for cooperation with the lower load cell of FIG. 9.

FIG. 6 illustrates in a side elevation plan view the cooperating upper load cell element 32 for element 34 of FIG. 5. The embodiments of FIGS. 5 and 6 show the use of two spaced apart cable channels while FIGS. 9 and 10 show a single cable channel. Turning to FIG. 7, it may be seen that the cable channels 83*a* and 83*b* may be provided with a radiused edges 87*a*, 87*a*', 87*b* and 87*b*'. These edges are formed on the sides of the cable channel holes whose tangent t is perpendicular to the direction of traffic (arrow T) or the direction in which the post is intended to deflect when struck. Again, the application of a radius to these particular edges of the channel openings while keeping the opposite side edges straight facilitates the yielding of the post on impact and the edges guide return to the upright position and improving the alignment of the load assembly. It should be understood that FIG. 8 shows the complimentary and cooperating upper load cell element with radiused edges 45*a*, 45*a*', 45*b* and 45*b*'.

Figure 11:
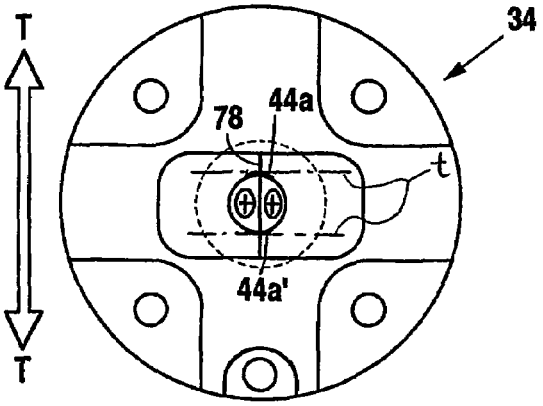
FIG. 11 shows a top plan view of the lower load cell element of FIG. 9, emphasizing the radius edges on a portion of the cable channel opening.
Figure 12:
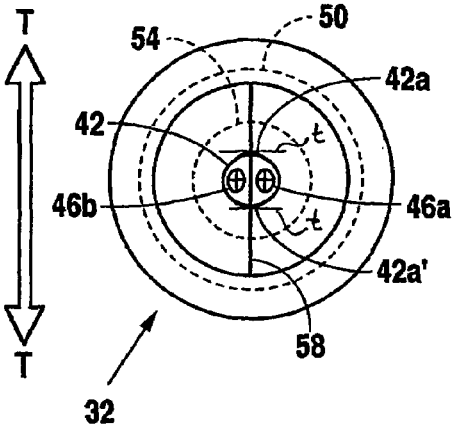
FIG. 12 is a top plan view of the upper load cell element of FIG. 10, emphasizing the radius edges at the cable channel opening.

As previously stated, FIGS. 9 and 10 illustrate the load cell elements 32 and 34 with a single cable channel having two spaced apart cables extending through the one channel. It should be understood from FIGS. 11 and 12 that the radiused edges 42*a*, 42*a*', 44*a* and 44*a*' function in the same way as discussed above to facilitate post yielding and realignment.

Figure 5A:
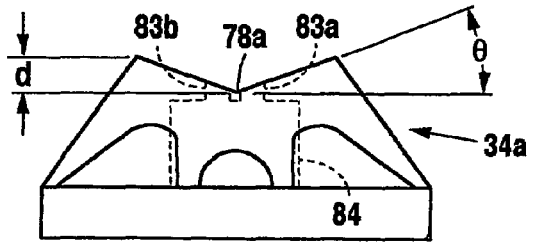
FIG. 5A is a side elevation plan view of a lower cell element with the orientation alignment edge configured as a concave notch in the cell head portion.
Figure 6A:
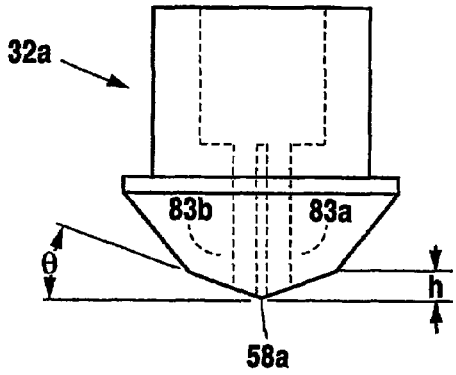
FIG. 6A shows an upper cell element with the orientation alignment edge configured as a convex ridge.

FIG. 5A illustrates a side elevation view of a lower cell element 34*a* wherein the head portion has been provided with an orientation alignment notch 78*a* (rather than a ridge) and has two spaced apart cable channels 83*a* and 83*b*. FIG. 6A shows a cooperating upper load cell element 32*a*.

Figure 9A:
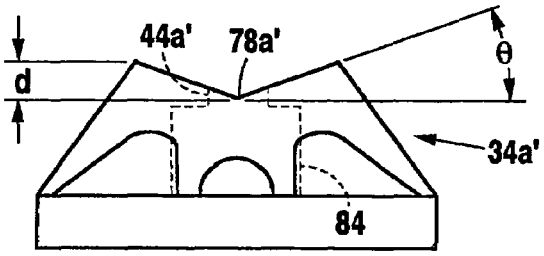
FIG. 9A illustrates a load cell element with a single cable channel and the concave notch in the cell head position.
Figure 10A:
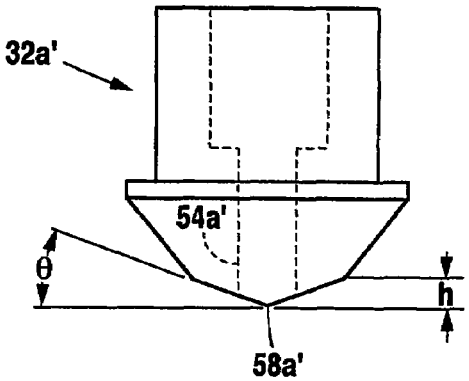
FIG. 10A shows an upper cell element with a single channel and the orientation alignment edge configured as a convex ridge.

In a similar manner, FIGS. 9A and 10A show the reversed notch/ridge arrangement of cells 34*a*' and 32*a*' with single cable channels 44*a*' and 58*a*'.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A load cell assembly for a self-uprighting delineator movable from a first position to a second position comprising:

upper and lower load cell elements;

said upper load cell element having a neck portion and a cap section, said cap section having an upper and lower end;

a load spring neck cavity in said neck portion;

an upper cable passage extending from inside said neck cavity through a cap face surface extending across the entire width of said lower cap end, said cap face surface having a first orientation alignment member, said first orientation alignment member tapering at an angle greater than 0° from the horizontal across said entire width of said lower cap end;

said lower load cell element having a base section and a head portion said head portion having an upper end and a lower section;

a cable locking base cavity in said base section;

a complimentary lower cable passage extending from inside said base section through a head face surface extending across the entire width of said upper end of said head portion, said complimentary lower cable passage axially aligned with said upper cable passage when said assembly is in said first position, said head face surface having a second orientation alignment member cooperating with said first orientation alignment member on said cap face surface for returning said upper and lower cable passages into said axially alignment in said first position after displacement of said assembly to said second position, said second orientation alignment member tapering at an angle greater than 0" from the horizontal across said entire width of said upper end, wherein said upper cable passage further comprises a first upper cable channel spaced apart from a second upper cable channel, said first orientation alignment member extending between said first and second upper cable channels, and said complimentary lower cable passage further comprises a first lower cable channel spaced apart from a second lower cable channel, said second orientation alignment member extending between said first and second lower cable channels.

2. The assembly of claim 1 wherein said first orientation alignment member across said cap face surface is a concave notch across said cap face surface, and said second orientation alignment member across said head face surface is a convex ridge across said head face surface.

3. The assembly of claim 1 wherein said first orientation alignment member across said cap face surface is a convex ridge across said cap face surface, and said second orientation alignment member across said head face surface is a concave notch across said cap for surface.

4. The assembly of claims 2 or 3 wherein said concave notch has a notch angle in the range of 5° to 20° from the horizontal and said convex ridge has a ridge angle in the range of 5° to 20° from the horizontal.

5. The assembly of claims 2 or 3 wherein said concave notch has a notch angle of approximately 13° from the horizontal and said convex ridge has a ridge angle of approximately 13° from the horizontal.

6. A load assembly for a delineator apparatus comprising:

upper and lower load cell elements;

said upper load cell element having a neck portion and a cap section, said cap section having an upper end and a lower end;

a cable locking recess cavity in said neck portion;

two spaced apart upper cell cable channels extending from inside said neck recess cavity through a cap face surface on said lower end of said cap section;

a portion of each of said upper cell cable channels having a radiused outer edge and an opposite side straight edge at said cap face surface;

a first orientation alignment member extending across the entire width of said lower end of said cap section along said cap face surface, said first orientation alignment member tapering at an angle greater than 0° from the horizontal across the entire width of said lower cap end;

said lower load cell element having a base section and a head portion, said head section having an upper end and a lower head portion;

a cable locking recess cavity in said base section;

two spaced apart lower cell cable channels extending from inside said host recess cavity through a head face surface on said upper end of said head portion;

a portion of each of said lower cell cable channels having a radiused outer edge and an opposite side straight edge at said head face surface; and a cooperating second orientation alignment member extending across the entire width of said upper end of said head portion along said cap face surface, said second orientation alignment member tapering at an angle greater than 0° from the horizontal across the entire width of said upper end of said head portion.

7. A load assembly for a self-uprighting delineator apparatus movable for a first orientation to a second orientation comprising:

upper and lower load cell elements;

said upper load cell element having a cap face surface;

an upper cable passage extending through said cap face surface of said upper load cell element, said upper cable passage having a first upper cable channel spaced apart from a second upper cable channel, said cap face having a first orientation alignment member extending across the entire width of said cap face between said first and second upper cable channels, said member tapering at an angle greater than 0° from the horizontal across said entire width of said cap face;

said lower cell element having a head face surface; and a complimentary lower cable passage extending through said head face surface of said lower load cell element, said complimentary lower cable passage axially aligned with said upper cable passage when said assembly is in said first orientation, said lower cable passage having a first lower cable channel spaced apart from a second lower cable channel, said head face surface having a second orientation alignment member cooperating with first orientation alignment member on said cap face surface for returning said upper and lower cable passages into said axially alignment in said first orientation after displacement of said assembly to said second orientation, said second orientation alignment member extending across the entire width of said head face surface between said first and second lower cable channels, said member tapering at an angle greater than 0° from the horizontal across said entire width of said head face surface.

* * * * *